United States Patent [19]

Summa

[11] 4,342,452

[45] Aug. 3, 1982

[54] TREADMILL DEVICE

[76] Inventor: H. Wayne Summa, Rte. 1, Box 466, Flemington, Mo. 65650

[21] Appl. No.: 115,542

[22] Filed: Jan. 25, 1980

[51] Int. Cl.[3] ..... A63B 23/06

[52] U.S. Cl. ..... 272/69

[58] Field of Search ..... 273/69, 70, 73, 131, 273/132, 97; 128/25 R, 25 B; 188/83, 65.5; 198/781, 804, 806, 808, 809, 810, 825, 835, 855; 193/35 A

[56] References Cited

U.S. PATENT DOCUMENTS

| | | | |
|---|---|---|---|
| 2,017,885 | 10/1935 | Atcheson | 272/69 |
| 3,066,788 | 12/1962 | Christiansen | 198/781 |
| 3,122,232 | 2/1964 | Burt | 198/781 |
| 3,554,541 | 1/1971 | Seaman | 273/69 |
| 3,627,091 | 12/1971 | Fleischauer | 193/35 A |
| 3,642,279 | 2/1972 | Cutter | 272/69 |
| 3,689,066 | 9/1972 | Hagen | 272/69 |
| 3,810,538 | 5/1974 | Moyer | 198/781 |
| 4,006,815 | 2/1977 | Werntz | 198/781 |
| 4,109,782 | 8/1978 | Nakai | 198/781 |

*Primary Examiner*—Richard C. Pinkham

*Assistant Examiner*—T. Brown

*Attorney, Agent, or Firm*—Fishburn, Gold and Litman

[57] ABSTRACT

A treadmill exercising device comprises a rigid frame having spaced first and second side members and front and rear end members with a plurality of rollers positioned laterally across the frame. The rollers are rotatably supported in plate members affixed to the side members and have opposite end portions, one of which has an end cap so as to provide a longitudinally extending series of end caps. An endless belt extends longitudinally of the frame along the first side member in contact with the series of end caps in driving engagement whereby rotation of several of the rollers rotatably drives other of the rollers in unison therewith. A braking carriage is slidably mounted to the first side member and has a plurality of grooved wheels rotatably mounted therein. The braking carriage is positioned adjacent the aligned roller end caps and the grooved wheels engage the belt. An adjustable jack screw is affixed to the front end member and extends to a forward end of the braking carriage to slide the braking carriage forwardly and rearwardly between non-braking and braking positions.

3 Claims, 7 Drawing Figures

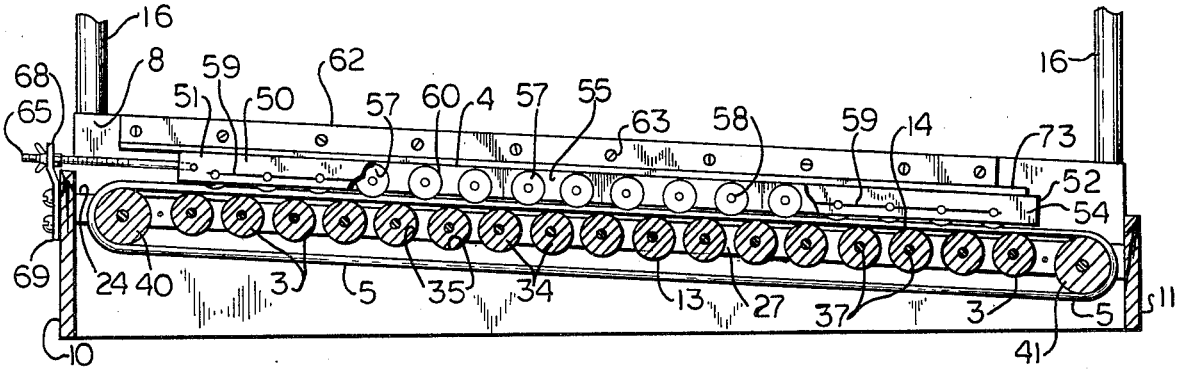
Fig. 3.
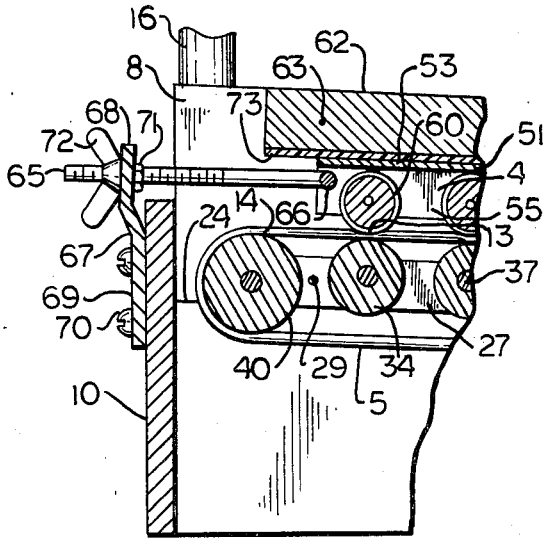
Fig. 4.
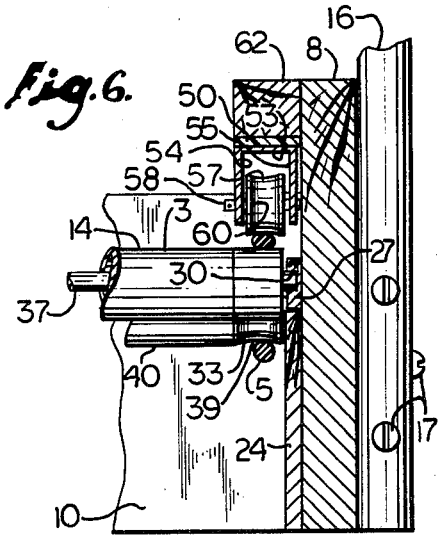
Fig. 6.
Fig. 5.
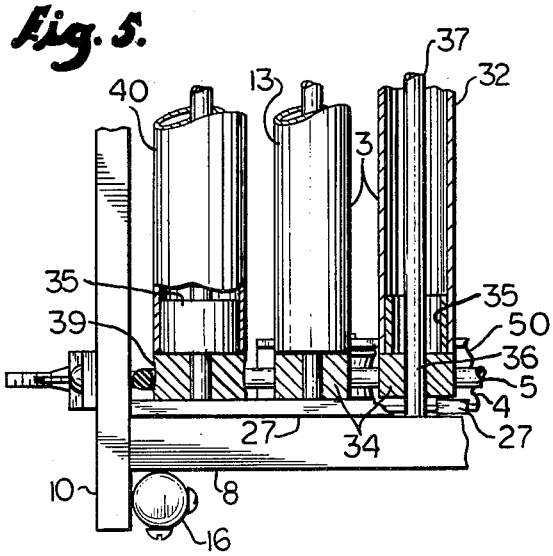
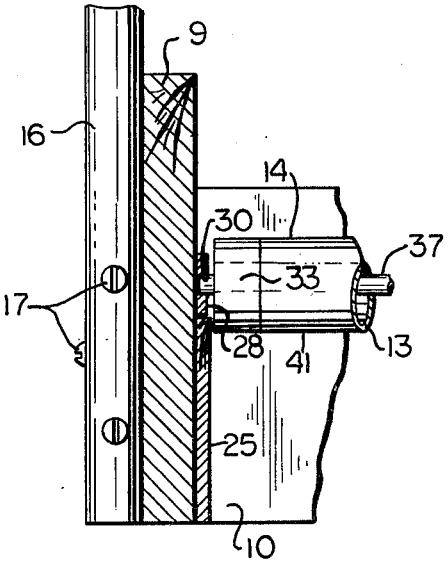
Fig. 7.

TREADMILL DEVICE

This invention relates to treadmill devices and particularly to such devices having belts therewith to control free movement of the treadmill rollers.

Various types of treadmill devices are known in the art and are constructed to provide a means for physical rehabilitation, post-operative recuperation, and general all-around exercise. Many such treadmill devices utilize free spinning rollers which do not sufficiently provide exercise for a person walking on same as at least some resistance to walking or jogging is generally necessary for proper exercise and conditioning. In other treadmill structures, a relatively wide belt arrangement encircles all or substantially all of the rollers and provides a supportive surface on which the person walks or jogs. Typically, these wide belts stretch with usage and become cocked or misaligned whereby the belt rotation becomes jerky or otherwise unsuitable and may cause rapid wear and deterioration of the belt.

The objects of the present invention are: to provide a treadmill device having a plurality of rollers therein and adapted for use by a walker or jogger for exercise and physical conditioning; to provide such a treadmill device having a plurality of rollers rotatably positioned in a frame and in closely spaced relationship whereby the upper surface of the rollers provides a supportive surface or platform for the walker or jogger; to provide such a treadmill device wherein the rollers have aligned end caps contacting a thin, elongate, endless belt extending therearound and engaging same in driving relation whereby rotation of several of the rollers rotatably drives substantially all of the rollers in unison therewith; to provide such a treadmill device having a braking means mounted therewith which is operable to selectively control braking pressure and regulate rotation of the rollers; to provide such a braking means having a plurality of grooved wheels in rotative engagement with the belt and whereby the braking means is selectively employed to shift the wheels thereof in and out of braking relation with the belt; and to provide such a device which is relatively inexpensive, highly reliable in use and well adapted for its intended purpose.

Other objects and advantages of this invention will become apparent from the following description taken in connection with accompanying drawings wherein is set forth by way of illustration and example, a certain embodiment of this invention.

FIG. 3 is a longitudinal sectional view taken along lines 3—3, FIG. 2.

FIG. 4 is an enlarged, fragmentary view showing details of a front portion of the treadmill device.

FIG. 5 is an enlarged, fragmentary view taken from the bottom of the treadmill device and showing a front corner portion thereof.

FIG. 6 is an enlarged, fragmentary view showing details of one side of the treadmill device.

FIG. 7 is an enlarged, fragmentary view showing details of the other side of the treadmill device.

Figure 1:
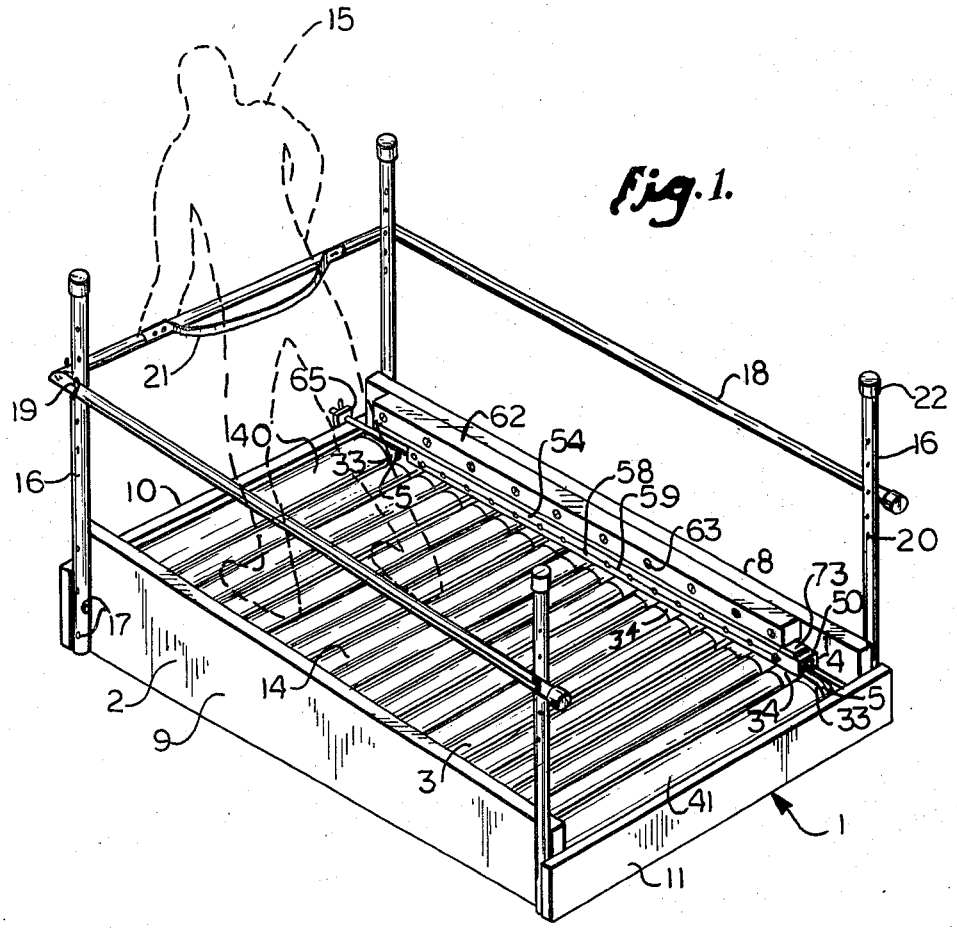
FIG. 1 is a perspective view of the treadmill device embodying this invention and showing an exercising person thereon.
Figure 2:
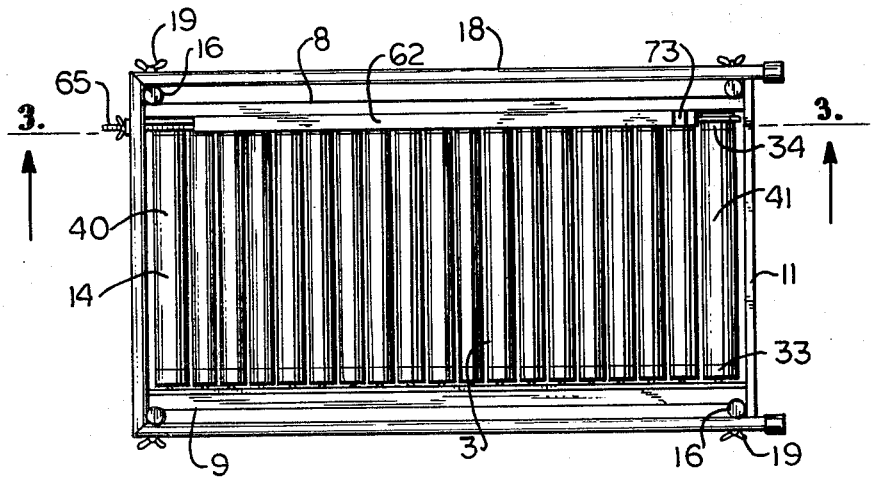
FIG. 2 is a plan view of the treadmill device.

As required, a detailed embodiment of the present invention is disclosed herein, however, it is to be understood that the disclosed embodiment is merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Referring more in detail to the drawings:

The reference numeral 1 generally indicates a treadmill device embodying the present invention, and comprising a frame 2 with a plurality of rollers 3 rotatably mounted therein and driven in unison by a belt 5 as set forth hereinbelow. A braking means 4 is slidably mounted to the frame 2 and includes means engaging the belt 5 and movable into a braked position exerting a force thereon to compress or pinch the belt 5 between end portions of the rollers 3 and the braking means 4 and thereby restrict free movement of the belt 5 and the rollers 3 to provide resistance while using the treadmill device 1 to increase muscular workload.

In the illustrated example, the frame 2 is rigid and has spaced front and second side members 8 and 9 and front and rear end members 10 and 11 affixed in rectangular relation as by fasteners or the like. The frame 2 is preferably of wood although synthetic thermoplastic resinous material, metal or the like suitable material having sufficient structural rigidity for the desired purpose may be used as desired. The rollers 3 are spaced a slight distance apart within the frame 2 and extend laterally between the side members 8 and 9 to provide a lower surface 13 and an upper surface 14 for walking or jogging thereon. The rollers 3 are arranged in the frame 2 to provide a platform therein and, to aid an exercising person 15 to remain steady on the roller platform, upright standards 16 are positioned at all four corners of the frame 2 and are affixed at lower ends to the frame members 8, 9, 10 and 11 such as by bolts 17 or the like. In the illustrated example, the front and rear end members 10 and 11 protrude slightly beyond the juncture thereof with the side members 8 and 9 whereby the standards 16 are respectively affixed both to the side members 8 and 9 and the end members 10 and 11. A handrail 18 in the shape of a "U" extends around the standards 16 and provides an opening at the rear of the frame and a closure at the front of the frame whereby the exercising person 15 may grip the handrail 18 for support. Although it is preferred that the handrail be non-adjustable, it is within the concept of this invention that the handrail may be adjustable in height to accomodate persons of different height and to this end, wingbolts 19 may be selectively positionable in one of a plurality of apertures 20 in the standards 16. Additionally, the exercising person 15 may wear a retaining belt 21 to aid in maintaining position relative to the front portion of the handrail 18. The standards 16 and handrail 18 are preferably formed of a sturdy material such as wood and may include suitable end caps 22 at the ends thereof.

Preferably, the rollers 3 are positioned so that the platform formed thereby is inclined from the front to the rear of the frame 2 whereby the exercising person 15 continually walks upslope or uphill. To mount the rollers 3 within the frame 2, opposite side members 8 and 9 include respective rearwardly and downwardly sloping abutment members 24 and 25 each providing an upper supportive surface or ledge. Spaced side plate or bracket members 27 and 28 are affixed in parallel relation to the first and second side members 8 and 9 by fasteners such as screws 29 and positioned upon the respective abutment members 24 and 25. Each of the side plate members 27 and 28 include bearings or openings 30 for receiving axle shafts of the rollers 3, described below.

Each of the rollers 3 includes an elongate, central portion 32, FIG. 5 with first and second end caps 33 and 34 coaxially affixed thereto. The end caps 33 and 34 each include a skirt portion 35 of slightly lesser diameter than the roller central portion 32 whereby the skirt portion 35 is inserted into an open end of the central portion 32 and secured thereto as by gluing or the like. The end caps 33 and 34 each include an axial bore 36 and an axle 37 is extended through the roller 3 and through the bores 36 and supported in coaxial relation to the roller by the first and second end caps 33 and 34. Provision may be made for an interior reservoir (not shown) within each of the rollers 3 whereby a fluid or the like can be supplied thereinto for increasing weight and resistance to rotation of the rollers 3.

The end caps 34 provide an outer surface for driving engagement with the belt 5 and are positioned in front to rear longitudinal alignment along the first side member 8.

The belt 5 is preferably smooth, thin, elongate and endless and extends longitudinally along the first side member 8 and, in the illustrated example engages the end caps 34 generally at the upper surface thereof so as to overlie the same. The belt 5 travels around end caps 34 of enlarged front and rear end rollers 40 and 41 having greater diameter than the rollers 3 and thereby is maintained in a spaced relation from a lower surface 13 of the rollers 3. The end rollers 40 and 41 each have grooves 39 in the end caps thereof in which the belt 5 is received so that the belt tracks parallel to the first side member 8 and does not tend to become skewed or misaligned during rotation of the rollers 3, 40 and 41.

The belt 5 contacts the upper surfaces 14 of all of the rollers 3 in driving relation whereby rotation of several of the rollers 3, as by walking thereon, rotatably drives generally all of the rollers 3 in unison therewith. The thin elongate belt 5 remains in contact with the end caps 34 and tracks straight thereon along the first side member 8 and does not become skewed or misaligned with respect to the rollers 3. The belt 5, in distinction to relatively wide belts covering rollers, does not tend to bind or become otherwise unsatisfactory in performance. In the illustrated example, only the first side member 8 has the thin elongate belt 5 adjacent thereto. However, it is within the concept of this invention that spaced belts may be employed adjacent each of the side members 8 and 9. In practice, only one belt 5 extending along one side of the rollers 3 is generally necessary for effective, unified driving thereof.

The exemplary braking means 4 includes a carriage 50 having front and rear end portions 51 and 52, an upper wall 53 and spaced side walls 54 and 55 defining an open bottom. The carriage 50 has a plurality of grooved wheels 57 rotatably mounted therein by axle pins 58 extending laterally through the side walls 54 and 55 and having an enlarged head at one end thereof and a bore transversely extending through the other end thereof whereby an elongate safety wire 59, FIG. 1, extends through aligned bores to secure the axle pins 58. The grooved wheels 57 have spaced flanges 60 whereby the wheels 57 ride on the belt 5 and the belt 5 is maintained in position thereunder by the flanges 60.

In the illustrated example, the braking carriage 50 is positioned in overlying relation to the roller end caps 34 and the belt 5 is situated between the end caps 34 and the grooved wheels 57 of the braking carriage 50 with the belt 5 engaging both the end caps 34 and the wheels 57 and causing both to spin upon rotation of one or several of the rollers 3, as by a person walking or jogging thereon.

To maintain the braking carriage 50 generally against the belt 5 and prevent upward movement thereof, an elongate abutment member 62 overlies the braking carriage 50. The braking carriage 50 is attached to the first side member 8 as by screws 63 or the like.

To provide for variable braking action, the carriage 50 is movably mounted relative to the first side member 8 and the end caps 34 of the rollers 3. The grooved wheels 57 of the carriage 50 are selectively movable fore and aft to bear down upon the belt 5 and the rollers 3 in varying degrees of force which may be controlled to provide proper muscular workload. A jack screw 65 has one end thereof mounted for up and down swinging movement to the front end portion 57 of the carriage 50 as by a pin 66 extending transversely through the side walls 54 and 55. The remote end of the jack screw 65 extends forwardly and through a bracket 67 having an upstanding upper end portion 68 and a lower portion 69 affixed to the front end member 10 as by screws 70 or the like. A lock nut 71 is threaded onto the jack screw 65 on one side of the arm portion 68 and a wing nut 72 is threaded thereon on the other side of the upper arm portion 68 whereby the jack screw 65 is translatable through the bracket 67 to longitudinally slide the carriage 50 therewith. To facilitate sliding movement, an elongate strip 73 of material having relatively slick surfaces such as plastic or the like, is positioned between the upper wall 53 of the carriage 50 and the lower surface of the abutment support member 62.

In the use of the treadmill device 1, a person 15 simply walks onto the upper surface 14 of the rollers 3 and begins to walk or jog thereon while holding onto the handrails 18 or suitably tethered by the retaining belt 21 as desired. As the person walks, rotation of some of the rollers immediately under his or her feet drives the belt 5 therewith which simultaneously drives other rollers 3 in unison therewith, thereby inhibiting free spinning of the rollers 3 and providing sufficient exercise. As the person 15 develops or regains physical strength and resistance to fatigue, the muscular workload applied by the braking means 4 is preferably increased by variably moving the carriage 50 from a non-braked position, FIG. 3, having the grooved wheels 57 thereof engaging the belt 5 and situated above and between the rollers 3, to a fully braked position, FIG. 4, with the grooved wheels 57 engaging the belt 5 and situated directly above the end caps 34. In the fully braked position, FIG. 4, the belt 5 is effectively squeezed or pinched between the end caps 34 and the grooved wheels 57. The squeezing or pinching of the belt 5 retards or restricts movement thereof and thereby retards rotation of the rollers 3, 40 and 41. By adjusting the longitudinal position of the jack screw 65 relative to the front end member 10, the braking carriage 50 slides back and forth into a selected position to pinch the belt 5 in varying amounts of pressure and provide selected amounts of resistance to rotation of the rollers 3.

It is to be understood that while one form of this invention has been illustrated and described, it is not to be limited to the specific form or arrangement of parts herein described and shown, except insofar as such limitations are included in the following claims.

What is claimed and desired to secure by Letters Patent is:

1. A treadmill exercising device comprising:

(a) a rigid frame having spaced side members and front and rear ends;

(b) a plurality of rollers positioned within said frame and extending laterally between said side members and providing a central upper surface for walking directly upon said rollers; said rollers having opposite end portions rotatably mounted to said side members;

(c) drive means engaged with said rollers and spaced laterally from said central upper surface, said drive means unifying said rollers in driving relation whereby rotation of some of said rollers causes rotation of other of said rollers and controls free rotation of all of said rollers;

(d) braking means connected to said rollers and movable between a first position at which the resistance to rotation of said rollers is at a minimum and a second position at which the resistance to rotation of said rollers is at a maximum; wherein (e) said braking means is a carriage slidably mounted to said one of said side members and controllably movable front to rear, said carriage having a plurality of wheels rotatably mounted thereto; and (f) said carriage is mounted adjacent said rollers and is movable between a first position with said wheels spaced longitudinally between said rollers and a second position with said wheels individually generally posititoned against said rollers and exerting pressure upon said drive means to provide braking force on said rollers.

2. The treadmill device set forth in claim 1 including:

(a) a screw member connected to said carriage and said frame and operable to slide said carriage forwardly and rearwardly in said frame whereby said carriage moves between said minimum-braked and braked positions.

3. A treadmill exercising device comprising:

(a) a rigid rectangular frame having spaced first and second side members and front and rear end members;

(b) a plurality of rollers closely spaced a distance apart within said frame, extending laterally between said side members, and providing an upper surface and a lower surface;

(c) said rollers respectively having spaced end portions with axle shafts projecting therefrom; respective ones of said end portions having end caps thereon positioned in longitudinal alignment from front to rear;

(d) spaced side bracket members affixed to said side members in parallel relation therewith and in inclined orientation sloping downwardly from front to rear; said side bracket members having a plurality of axle openings therein receiving and supporting said axle shafts whereby said rollers provide a supportive surface for exercising thereon;

(e) a thin, elongate endless belt extending longitudinally in said frame generally adjacent said first side member and contacting said end caps in driving engagement therewith whereby rotation of several of said rollers rotatably drives substantially all of said rollers of greater diameter than said rollers therebetween and in unison therewith;

(f) front and rear end rollers of larger diameter than said rollers and rotatably mounted adjacent said front and rear end members and having grooved end caps longitudinally aligned with the end caps of said rollers therebetween and engaged with said belt for straight tracking return thereof below the lower surface of said rollers therebetween;

(g) a braking carriage slidably mounted to said first side member and having front and rear end portions spaced side walls and a plurality of grooved wheels respectively having a circumferential groove therearound and rotatably mounted between said side walls and closely spaced said distance apart; said braking carriage positioned in overlying relationship to said roller end caps and with said grooved wheels engaging said belt; and (h) a jack screw having one end connected to said braking carriage and extending forwardly therefrom and having another end affixed to said front end member, said jack screw being longitudinally translatable relative to said front end member to slide said braking carriage forwardly and rearwardly between a minimum-braked position having said wheels individually situated above and between said end caps and a fully braked position with said wheels situated directly above said end caps and bearing forcefully against said belt whereby said belt is pinched between said wheels and said end caps to inhibit rotation of said rollers.

* * * * *